US006257715B1

(12) United States Patent
Thielman et al.

(10) Patent No.: US 6,257,715 B1
(45) Date of Patent: Jul. 10, 2001

(54) INK JET PRINTER WITH INK CONDUIT GAS EXHAUST FACILITY AND METHOD

(75) Inventors: Jeffrey L. Thielman; Mark A. Smith, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/520,645

(22) Filed: Mar. 7, 2000

(51) Int. Cl.[7] ..... B41J 2/175
(52) U.S. Cl. ..... 347/92; 347/85
(58) Field of Search ..... 347/84, 85, 86, 347/87, 92, 40

(56) References Cited

U.S. PATENT DOCUMENTS

| | | | |
|---|---|---|---|
| 4,510,510 | 4/1985 | Terasawa | 347/30 |
| 4,628,333 | 12/1986 | Terasawa | 347/87 |
| 4,847,637 | 7/1989 | Watanabe et al. | 347/30 |
| 4,999,652 | 3/1991 | Chan | 347/86 |
| 5,185,614 | 2/1993 | Courian et al. | 347/24 |
| 5,506,611 | 4/1996 | Ujita et al. | 347/85 |
| 5,774,154 | 6/1998 | Underwood | 347/86 |
| 5,847,734 | 12/1998 | Pawlowski, Jr. | 347/86 |
| 5,975,677 * | 11/1999 | Marler et al. | 347/40 |

* cited by examiner

*Primary Examiner*—N. Le
*Assistant Examiner*—Anh T. N. Vo

(57) ABSTRACT

An ink jet printer has a body with a paper path and a carriage operable to reciprocate across the paper path. An ink supply receptacle on the body is spaced apart from the carriage, and an ink conduit extends between the ink supply receptacle and a fluid output interconnect on the carriage. A gas release facility connected to the conduit allows air to be released from the conduit when the printer is first to be used. This may occur in response to filling the conduit with ink, and the facility may be near the carriage end of the conduit to allow substantial evacuation of air from the conduit. The facility may prevent further release of gas or fluid when wet, such as provided by a porous polymer material.

20 Claims, 3 Drawing Sheets

INK JET PRINTER WITH INK CONDUIT GAS EXHAUST FACILITY AND METHOD

FIELD OF THE INVENTION

This invention relates to ink jet printers, and particularly to ink jet printers with remote ink supplies.

BACKGROUND AND SUMMARY OF THE INVENTION

A typical ink jet printer has a pen that reciprocates over a printable surface such as a sheet of paper. The pen includes a print head having an array of numerous orifices through which droplets of ink may be expelled onto the surface to generate a desired pattern. Some ink jet printers have a replaceable ink supply mounted to a stationary position on the printer, and connected to a reciprocating print head by a conduit. This permits the use of a larger ink supply, and avoids the need to replace the print head each time the supply of ink is depleted. Color ink jet printers generally have several ink supply cartridges each containing a different color of ink, or a multi-chamber cartridge.

Printers with remote or "off axis" ink supplies are normally shipped with the ink supplies and print head removed. The ink conduit is empty, open to ambient air, or in a "dry" condition. This avoids potential leakage of the ink and shelf life reduction that begins when the seal of an ink supply cartridge is penetrated. More significantly, if ink were to remain in the ink conduit for an extended period between manufacturing and first use, air may be absorbed by the ink, and water evaporated. This would undesirably change the consistency of the ink beyond normal parameters. In addition, the print head may be protected in special packaging against potential shocks during shipping. When printers are shipped "dry," the ink conduits are empty, except for the presence of ambient air.

When setting up such a printer for its first use, as ink flows from the ink supply to the print head and its on-board reservoir, the air volume within the ink tube is forced into the print head reservoir. If the reservoir is sufficiently large, this can be readily accommodated, but leaves a substantial air volume in the reservoir. Thereafter, ambient pressure or temperature variations, such as caused by changing weather or air travel, can generate pressure changes in the air bubble that undesirably force ink from the orifices. The consequences of such leakage or "drool" include user inconvenience, printer damage, and impaired printing.

Current systems may address this problem with a startup or "dummy" printhead that is removed after air in the tubes is displaced by ink, then replaced by the user with a functional pen for printing. Such startup printheads may have a receptacle to accept air from the tubes, possibly including a suction device to inhale the air, and to draw ink into the tubes. Another system uses a Porex® self sealing porous plastic element on the dummy pen. When ink is pumped from the ink supplies to the pen to prime the tubes, air in the tubes is released through the porous element to the atmosphere. When the tubes are essentially full, ink reaches the porous element and wets it, sealing it against further emission of fluid or additional gas. Then, the startup printhead is removed by the user and replaced with a standard printhead.

While effective, such systems have certain disadvantages. In some cases, an inexperienced user may mistakenly remove the startup printhead without conducting the priming step. Such errors cause the new printhead to be filled with air, possibly rendering it unusable. Even when the startup printhead is properly used, the replacement process is a moderate inconvenience, and may be somewhat messy, due to residual ink on the startup printhead.

The present invention overcomes the limitations of the prior art by providing an ink jet printer having a body with a paper path and a carriage operable to reciprocate across the paper path. An ink supply receptacle on the body is spaced apart from the carriage, and an ink conduit extends between the ink supply receptacle and a fluid output interconnect on the carriage. A gas release facility connected to the conduit allows air to be released from the conduit when the printer is first to be used. This may occur in response to filling the conduit with ink, and the facility may be near the carriage end of the conduit to allow substantial evacuation of air from the conduit. The facility may prevent further release of gas or fluid when wet, such as provided by a porous polymer material.

DETAILED DESCRIPTION OF A PREFERRED EMBODIMENT

Figure 1:
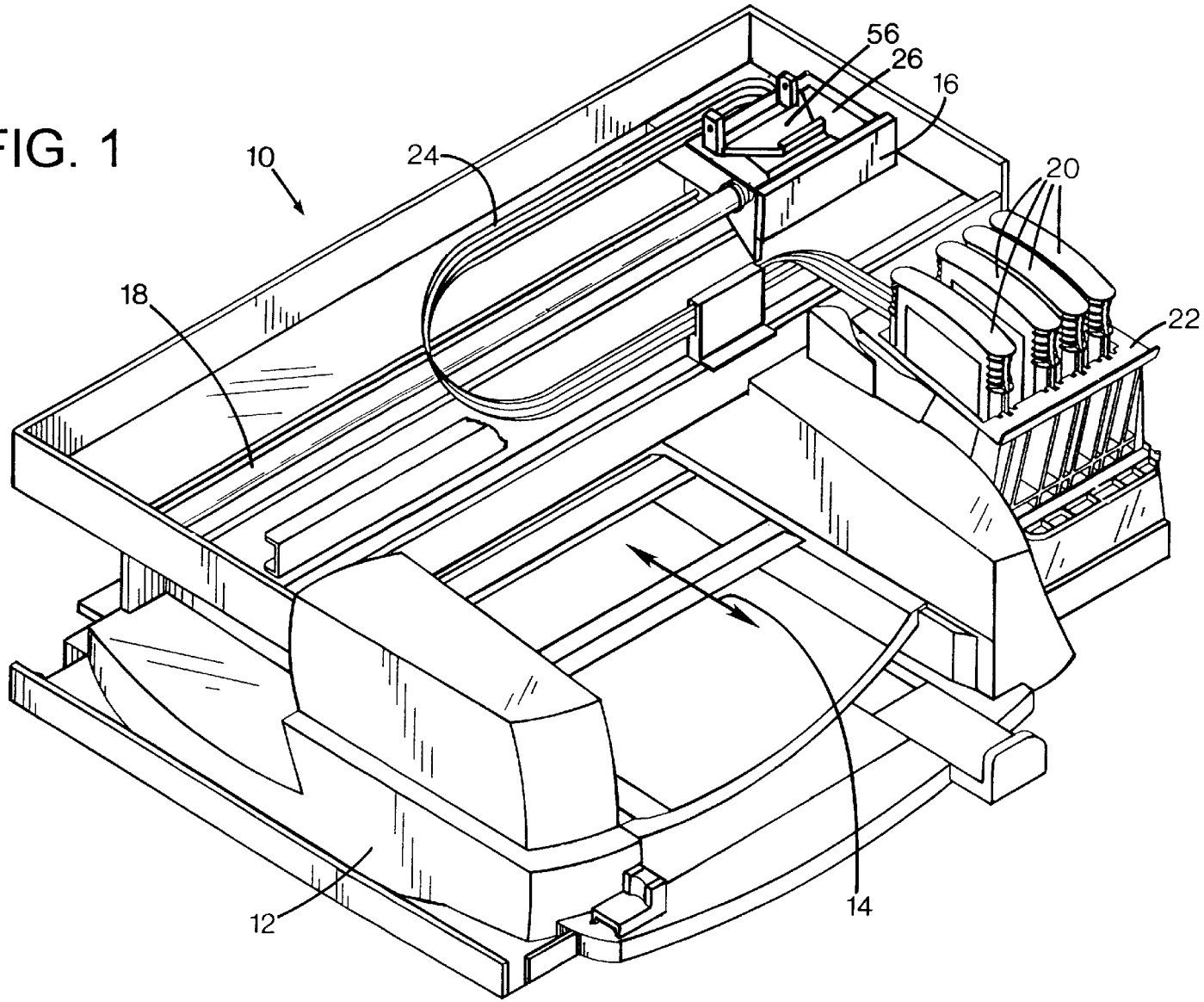
FIG. 1 is a perspective view of a printer according to a preferred embodiment of the invention.

FIG. 1 shows an ink jet printer 10 having a housing 12. A paper path 14 runs through the housing below a carriage assembly 16 that reciprocates along a rail 18 defining a scan axis. Four or more ink supply cartridges 20, each of a different color, are received in a stationary ink supply receptacle 22 defined in the housing. A flexible ink supply tube 24 defining four conduit passages, each connected to a respective one of the ink cartridges, extends in an arc to the carriage 16, and to an ink jet printhead 26 connected to the carriage. Although the printer is shipped without the ink cartridges installed, the illustration shows the printer's condition just after the ink cartridges have been installed by a user, the first step in preparing the printer for operation.

Figure 2:
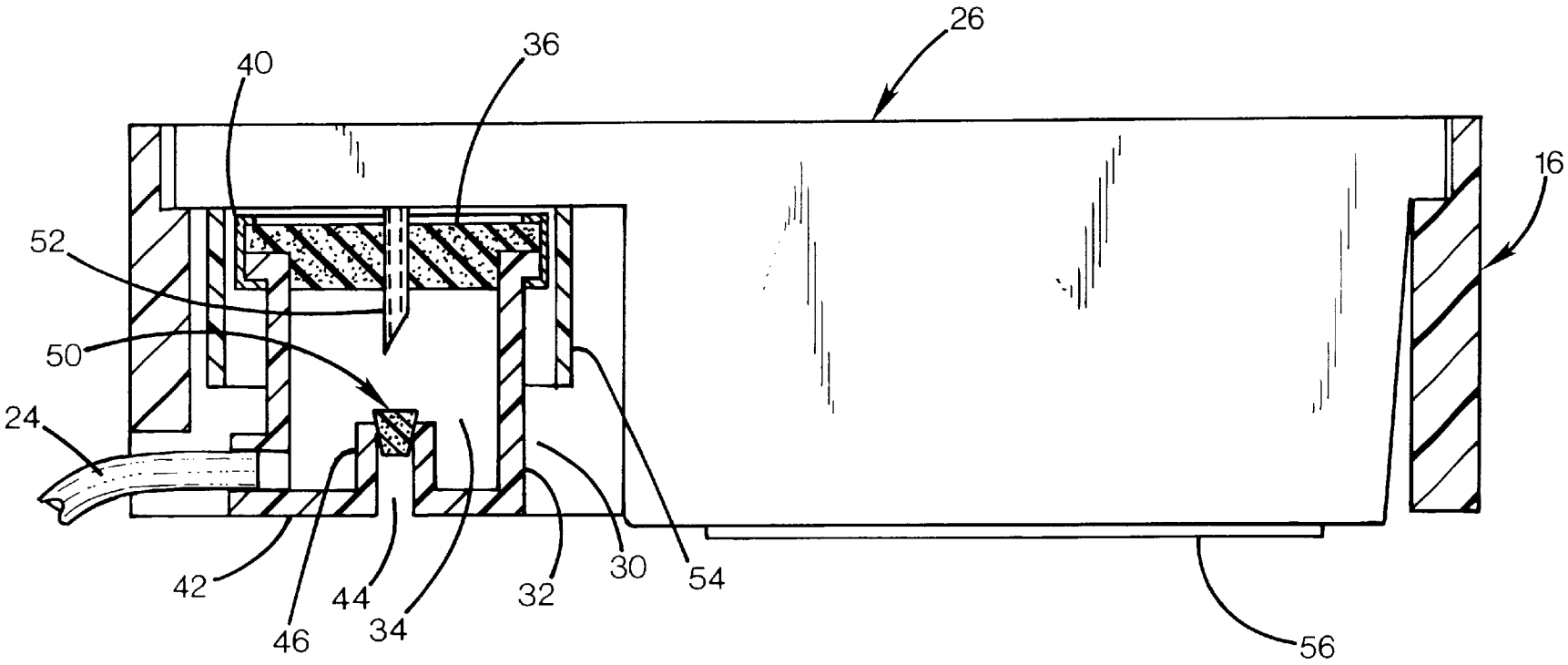
FIG. 2 is an enlarged sectional view of the embodiment of FIG. 1

FIG. 2 shows an enlarged view of the pen 26 in the carriage 16. The carriage includes a riser or fluid output interconnect 30 having a vertically oriented cylindrical wall 32 defining a chamber 34. The conduit 24 connects to the chamber at a lower portion of the chamber on one side. The upper end of the chamber is enclosed by a septum 36 formed of an elastomeric material having a central slit that is closed when no ink jet pen is present. The septum is secured to a flange at the upper edge of the riser by a crimp ring 40. The lower portion of the chamber is enclosed by a floor panel 42 defining a small aperture 44 from which a cylindrical tube 46 rises to an intermediate height in the chamber. The upper end of the tube is at a level above the aperture leading to the conduit, and well above the floor, so that any initial quantities of ink entering via the conduit are unlikely to reach the top of the tube 46.

A porous plastic plug 50 providing a gas release facility and means for sealing against fluid flow is received in the upper end of the passage defined by the tube 46, and is firmly wedged in place or otherwise secured to avoid any passages between the plug and the tube wall through which fluid might leak. In the preferred embodiment, the plug is installed via the upper aperture of the chamber, after which the septum is crimped in place. The plug is preferably a Porex® material, such as manufactured by Porex Technologies of Fairburn, Ga. The Porex material is manufactured to provide a multitude of interconnected passages that allow the passage of air and other gases, but which are of such narrow width that aqueous fluids such as ink used in ink jet pens will seal the flow.

Normally, the flow is sealed against gas or liquid flow by wicking of the ink into the passages by capillary action which retains the ink in place against the range of pressure differentials to which the system might be subject. A coating on the porous material acts when wetted to seal the pores, preventing ink or air migration through the pores Other gas release facility materials may prevent fluid flow simply by a non-wetting material that does not admit fluid into its passages, and which prevents fluid leakage. Thus, the preferred embodiment not only prevents ink from exiting, but permanently prevents air and any other gas or fluid contaminants from entering the chamber after the plug has initially been wet by ink.

In the preferred embodiment, the plug is of polyethylene material, with a length of 3 mm and a diameter of 2 mm. The plug material is normally manufactured by sintering plastic particles of a selected size. Preferably, this provides an air flow rate of 30 ml/minute at a pressure differential of 2.5 PSI. In alternative embodiments in which the conduit volume is less than the approximately 10 ml contemplated in the preferred embodiment, or in which printer installation procedures are not delayed by a purge cycle longer than the approximately 20 second duration selected for the preferred embodiment, a slower air flow rate may be tolerated, with values from 2–8 ml/minute and up. The above figure are provided for a single tub and Porex plug; most contemplated embodiments will have several conduits in parallel, with separate gas release facilities for each tube.

The porosity of the plug with a multitude of interconnected passages allows a limited air flow resistance even with a narrow mean passage diameter. An alternative embodiment may employ a plug having one or more separate capillary passages. However, such a device would have a limited air flow rate with passages effective at "locking up" with contact by fluid. Such devices have proven effective for low flow rates associated with back pressure equalization, and may not be suitable for applications requiring higher flow rates.

As further shown in FIG. 1, the pen 26 has a ink inlet needle 52 that penetrates the septum to provide sealed ink flow to the pen from the chamber 34. A skirt 54 extends from the pen to surround the needle to prevent injury. A print head 56 is connected to the body of the pen to expel ink droplets onto a sheet of media positioned in the paper path, parallel to and just below the print head. Although the illustration shows only one ink conduit and chamber for simplicity, the preferred embodiment pen has several independent conduits and chambers, each supplying a different color ink to permit full color ink jet printing.

Figure 3A:
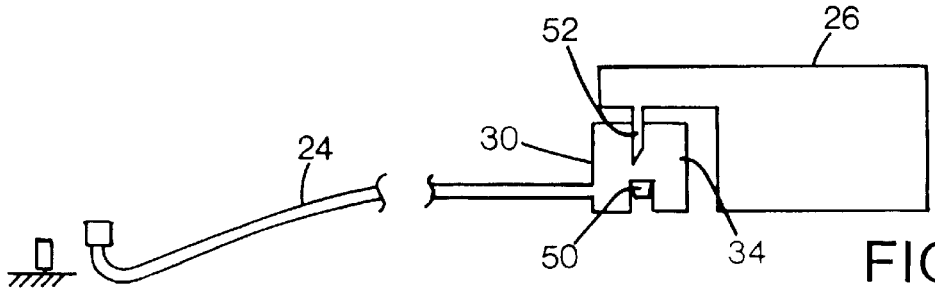
FIGS. 3A–3E are simplified sectional views showing a sequence of operation of the embodiment of FIG. 1.

FIGS. 3A–3E show a sequence of operations as the user first uses a new printer, with the components simplified and not shown to scale. FIG. 3A shows the system without the ink supply cartridge 22 installed, and the cartridges supplied with the printer are packaged separately in an environmentally sealed container to prevent leakage and to allow an extended shelf life during the potentially extended time after manufacturing before the printer is first used. The pen 26 is installed with the needle communicating with the chamber 34.

Figure 3B:
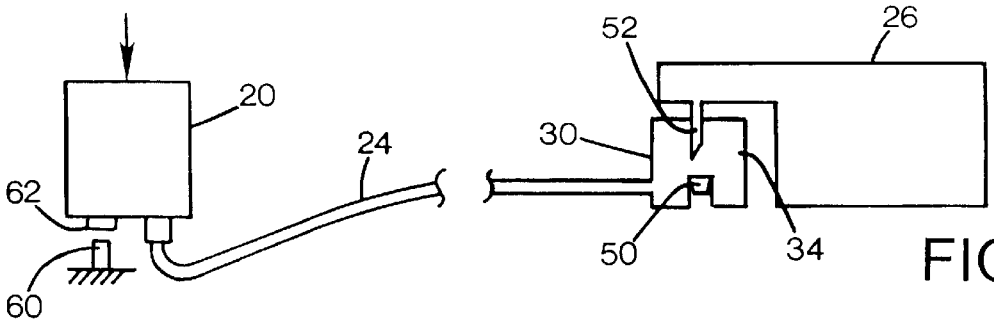
Figure 3C:
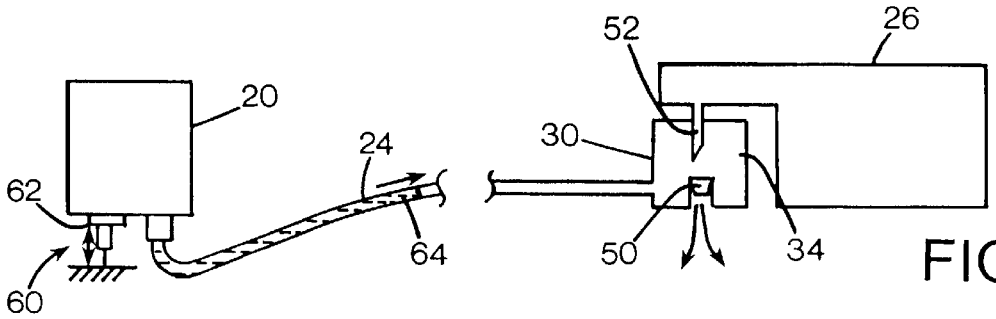

In FIG. 3B, the user has just installed the ink cartridge 20. This may initiate the priming process, in which the printer responds to the installation of each or all cartridges, either automatically, or by prompting the user. In FIG. 3C, the priming process has been initiated. A pump apparatus 60 operates to press on a diaphragm or alternative pump element 62 on the cartridge to generate ink pressure in the cartridge. Although shown symbolically, the preferred pump would be in the form of an air pump that forces air into the ink supply cartridge, in a gap between the interior of the cartridge and a flexible ink-containing bag. Consequently, ink 64 flows through the conduit 64, toward the fluid output interconnect 30 on the carriage. As the ink proceeds through the conduit, it displaces the air originally in the conduit. The air is released via the porous plug 50. In alternative embodiments, the pressure needed to advance ink through the conduit to displace air from the plug may be provided by any alternative means, including a gravitational height differential, a pre-pressurized ink cartridge, a suction pump at the pen end of the conduit, a suction device applied to the plug exterior, or any other means.

Figure 3D:
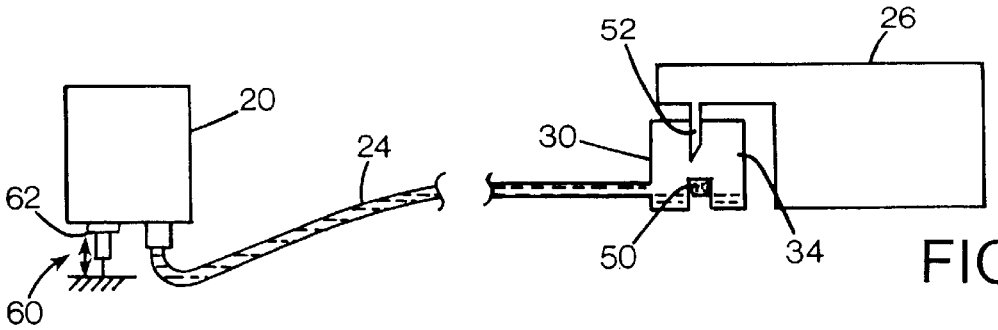

In FIG. 3D, the ink has reached the chamber 34, and risen to a level at which it contacts the plug 50. The plug consequently becomes fully wetted throughout its volume by the ink and sealed against further air emission, as well as against any ink emission or air or fluid admission. During the air emission phase, essentially no air is admitted to the pen due to the print head's greater airflow resistance than the plug. While the pen may tolerably hold a small air quantity, it lacks the volume capacity needed for ingesting the conduit air without becoming impaired or disabled.

Figure 3E:
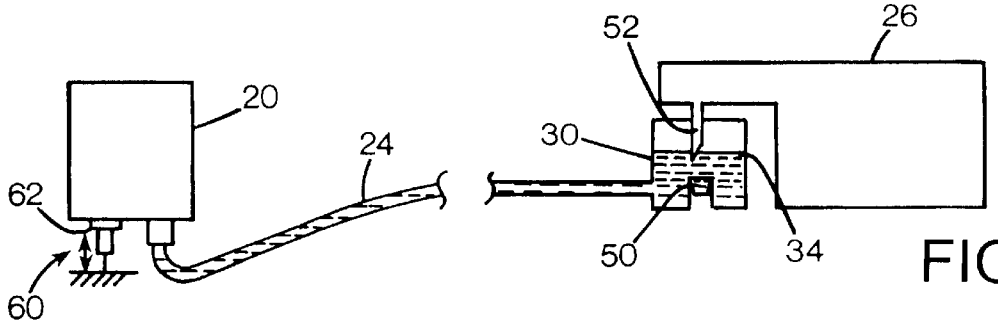

In FIG. 3E, pumping of ink has continued until the ink level reaches the needle aperture, whereupon the system is ready for printing. The small air volume displaced between the steps of FIGS. 3D and 3E is ingested into the pen, but this volume is in a minimal range of 0.1–0.2 ml, which is readily accommodated by the pen.

While the above is discussed in terms of preferred and alternative embodiments, the invention is not intended to be so limited. For instance, the Porex plug may be of any range of shapes and sizes. It may be positioned on a side wall of the chamber 34, or on a fitting at or near the conduit end at the carriage. The facility may also be provided by forming one of the portions of the pen, conduit or chamber out of the material. In an alternative embodiment in which the pen is expected to be occasionally replaced during a normal printer operating life, a portion of the pen may be made of the air-emitting and fluid sealing material. This would permit a re-priming process upon pen replacement, should the conduits become drained of ink during the intervening time prior to replacement. Other embodiments may employ different capillary devices or valves that allow the escape of air but which prevent the escape of fluid, and possibly the intake of air or fluid.

What is claimed is:

1. An inkjet printer comprising:

a body defining a paper path and having a carriage operable to reciprocate across the paper path;

an ink supply receptacle on the body, spaced apart from the carriage and containing a supply of ink;

a conduit filled with air, and extending between the supply receptacle and a fluid interconnect on the carriage;

a gas release facility in communication with the conduit and the gas release facility being operable to emit air displaced from within the conduit, and after ink contacts the facility to prevent further emission of air or ink.

2. The printer of claim 1 wherein the gas release facility is proximate the fluid output interconnect, such that a majority of air in the tube is evacuated when ink reaches the facility.

3. The printer of claim 1 wherein the fluid output interconnect is a body defining a chamber in communication with the conduit, in communication with a pen connector, and in communication with the gas release facility.

4. The printer of claim 1 wherein the gas release facility is a porous element.

5. The printer of claim 4 wherein the gas release facility is a polymeric material.

6. The printer of claim 4 wherein the porous element includes a coating that acts when wetted by ink to seal the element.

7. The printer of claim 1 wherein the gas release facility is operable to transmit gas when in a dry condition, and to prevent transmission of fluid when in a wet condition.

8. The printer of claim 1 including an ink jet pen connected to the fluid output interconnect.

9. The printer of claim 1 wherein the gas release facility includes sealing means for permanently preventing the transmission of ink and air.

10. An ink jet printer comprising:

a body defining a paper path and having a carriage operable to reciprocate across the paper path;

an ink-filled ink supply receptacle on the body and spaced apart from the carriage;

an air-filled ink conduit having a first end and a second end, the first end connected to the ink supply receptacle, the second end connected to a fluid output interconnect on the carriage; and selective gas transmission means connected to the conduit for relieving overpressure in the conduit when dry, and for permanently preventing ink and air flow therethrough when wet.

11. The printer of claim 10 wherein the gas transmission means is connected proximate the second end of the conduit.

12. The printer of claim 10 wherein the gas transmission means is proximate the fluid output interconnect, such that a majority of air in the tube is evacuated when ink reaches the facility.

13. The printer of claim 10 wherein the gas transmission means is a porous element.

14. The printer of claim 13 wherein the porous element includes a coating that acts when wetted by ink to seal the element.

15. The printer of claim 10 including an ink jet pen connected to the fluid output interconnect.

16. The printer of claim 10 wherein the gas transmission means includes sealing means for preventing the transmission of fluid.

17. The printer of claim 10 wherein the fluid output interconnect defines an aperture occupied by the gas transmission means.

18. A method of preparing an ink jet printer for printing comprising the steps:

providing a reciprocatable carriage having a pen receptacle connected to a remote ink-filled ink supply station by an air-filled conduit having a first end connected to the ink supply station and a second end connected to the pen receptacle;

forcing ink into the first end of the conduit;

while forcing ink into the conduit, releasing air from the conduit via a release element proximate the second end of the conduit; and in response to ink contacting the release element, permanently ceasing releasing air from the conduit.

19. The method of claim 18 including providing an ink jet pen in the pen receptacle prior to forcing ink into the conduit.

20. The method of claim 18 including, after ceasing releasing air from the conduit, continuing to supply ink to the pen receptacle while preventing emission of air.

* * * * *